US007641456B2

(12) United States Patent
Hahn

(10) Patent No.: US 7,641,456 B2
(45) Date of Patent: Jan. 5, 2010

(54) SCROLL COMPRESSOR WITH BACK PRESSURE CHAMBER CAVITY FOR ASSISTING IN START-UP

(75) Inventor: Gregory W. Hahn, Arkadelphia, AR (US)

(73) Assignee: Scroll Technologies, Arkadelphia, AR (US)

( * ) Notice: Subject to any disclaimer, the term of this patent is extended or adjusted under 35 U.S.C. 154(b) by 215 days.

(21) Appl. No.: 11/472,105

(22) Filed: Jun. 21, 2006

(65) Prior Publication Data

US 2007/0297929 A1 Dec. 27, 2007

(51) Int. Cl.
*F04C 18/00* (2006.01)
*F04C 2/00* (2006.01)

(52) U.S. Cl. ..... 418/55.5; 418/55.4; 418/57

(58) Field of Classification Search ..... 418/55.1–55.6, 418/57

See application file for complete search history.

(56) References Cited

U.S. PATENT DOCUMENTS

| | | | | |
|---|---|---|---|---|
| 5,989,000 | A * | 11/1999 | Tomayko et al. | 418/55.5 |
| 6,077,057 | A * | 6/2000 | Hugenroth et al. | 418/55.5 |
| 6,290,478 | B1 * | 9/2001 | Lifson | 418/55.5 |
| 6,416,301 | B2 * | 7/2002 | Bush et al. | 418/55.5 |
| 6,527,528 | B1 * | 3/2003 | Barito et al. | 418/55.5 |
| 6,554,592 | B1 * | 4/2003 | Sun et al. | 418/55.5 |

FOREIGN PATENT DOCUMENTS

| | | | | |
|---|---|---|---|---|
| JP | 05149270 A | * | 6/1993 | 418/55.5 |

* cited by examiner

*Primary Examiner*—Theresa Trieu
(74) *Attorney, Agent, or Firm*—Carlson, Gaskey & Olds

(57) ABSTRACT

A scroll compressor is provided with a cavity in its back pressure chamber to increase a volume of the back pressure chamber. In this manner, at start-up, the back pressure chamber will not be effective to bias the two scroll members together until this enlarged volume is filled with a compressed refrigerant. This reduces the load on the electric motor at start-up.

9 Claims, 2 Drawing Sheets

SCROLL COMPRESSOR WITH BACK PRESSURE CHAMBER CAVITY FOR ASSISTING IN START-UP

BACKGROUND OF THE INVENTION

This application relates to a scroll compressor, wherein a back pressure chamber is provided with a large cavity to reduce the start-up load on the motor. The large cavity must be filled with pressurized fluid as the compressor starts up before the scroll members can move into engagement with each other.

Scroll compressors have become widely utilized in refrigerant compression applications. In a typical scroll compressor, a first scroll member includes a base with a generally spiral wrap extending from the base. A second scroll member also has a base and a generally spiral wrap extending from its base. The two wraps interfit to define compression chambers. One of the two scroll members is caused to orbit relative to the other, and as they orbit, the size of the compression chambers is decreased, compressing an entrapped refrigerant.

A separating force is created by the compressed refrigerant that tends to push the two scroll members away from each other. To entrap and define a compression chamber, the wrap of each scroll member must be in contact with the base of the other scroll member. The separating force tends to move the wraps out of engagement, and thus prevents compression.

To address this separating force, scroll compressors have utilized a back pressure chamber defined behind the base of one of the two scroll members. A compressed refrigerant is tapped into this chamber, and creates a force tending to hold the two scroll members in contact with each other.

One challenge with scroll compressors is that at start-up the motor must begin to drive a shaft to cause the scroll member to orbit. At start-up, the load on this motor to begin the rotation of the shaft is relatively large. It would be desirable to reduce this start-up load.

SUMMARY OF THE INVENTION

In a disclosed embodiment of this invention, a back pressure chamber in a scroll compressor is provided with a relatively large cavity. This cavity must be filled with compressed refrigerant as the compressor begins to operate, before the back pressure chamber will bias the two scroll members together. Thus, at start-up, the two scroll members will be allowed to move out of contact with each other. Little compression will occur, reducing the load on the motor. Once the cavity has been filled with compressed refrigerant, the two scroll members will be driven into contact with each other, and normal operation can begin.

The present invention thus provides a simple but effective way of reducing a start-up load on a compressor.

In features of this invention, the back pressure chamber is defined between two spaced seals in a crankcase that supports the orbiting scroll member. The cavity is defined radially between the two seals. The cavity preferably extends 360° about an axis of rotation of the shaft. Further, the cavity is preferably more than twice as deep as grooves which receive the seals. The cavity also extends for a greater radial distance than do the cavities that receive the seals. The cavity preferably more than doubles the volume of the back pressure chamber. In one embodiment, the volume is increased fourfold.

These and other features of the present invention can be best understood from the following specification and drawings, the following of which is a brief description.

DETAILED DESCRIPTION OF THE PREFERRED EMBODIMENT

Figure 1:
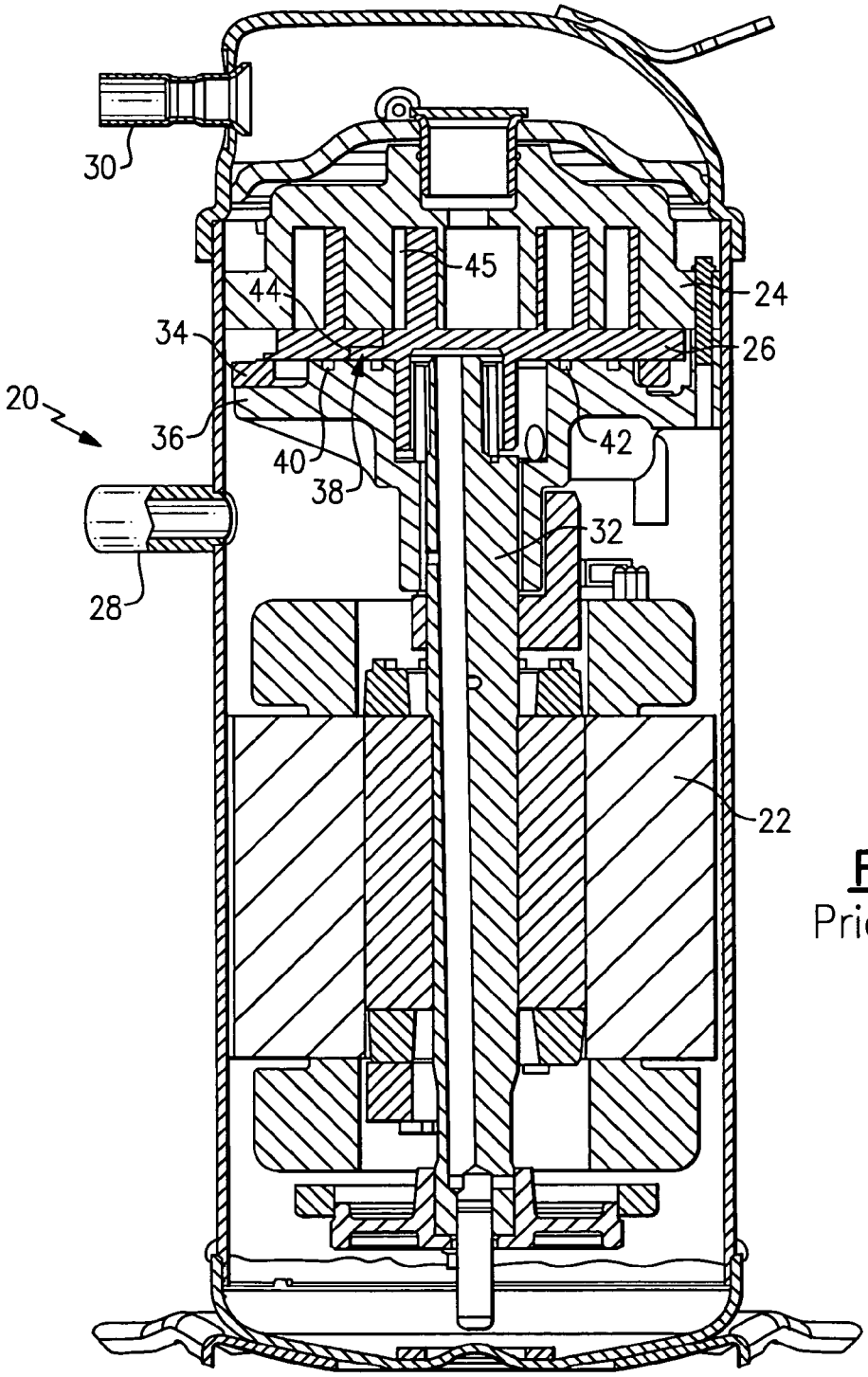
FIG.1 Prior Art
FIG. 1 shows a prior art scroll compressor.

A scroll compressor 20 is illustrated in FIG. 1. As known, a motor 22 is provided to drive a shaft 32. An orbiting scroll member 26 is driven by the shaft 32 to orbit relative to a non-orbiting scroll member 24. An Oldham coupling 34 converts the rotation of the shaft 32 to orbiting movement of the orbiting scroll member 26.

As also known, a suction port 28 allows refrigerant to enter the compressor 20, and a discharge port 30 delivers compressed refrigerant to a downstream user, such as a condenser in a refrigeration system.

A crank case 36 supports the orbiting scroll member 26. A back pressure chamber 38 is defined between an upper face of the crank case 36 and a rear face of the base of the orbiting scroll 26. While the back pressure chamber 38 is shown behind the orbiting scroll 26, it is also known to position a back pressure chamber behind the non-orbiting scroll, and this invention would extend to such a compressor.

Seal grooves 40 and 42 are formed in the crank case 36 and receive seals 50. These seals together define the radial limits of the back pressure chamber 38. A tap 44 taps compressed refrigerant from a compression chamber 45 to the back pressure chamber 38.

As known, the tapped refrigerant in the back pressure chamber 38 biases the orbiting scroll 26 upwardly against the non-orbiting scroll 24 to entrap refrigerant in the compression chambers 45. Without the back pressure chamber, a separating force, created by the pressurized refrigerant in the chamber 45, would tend to drive the two scroll members 24 and 26 away from each other.

At start-up of the compressor 20, there is a high load on the motor 22. The motor must drive the shaft 32 against the resistance of both inertia, and as compression of the refrigerant begins. With the prior art, the back pressure chamber 38 quickly becomes operative as the orbiting scroll 26 begins to orbit. The back pressure chamber is essentially defined by two closely spaced flat surfaces, and thus it quickly fills, biases the two scroll members 24 and 26 together, and the resistance that must be overcome by the motor 22 increases.

Figure 2:
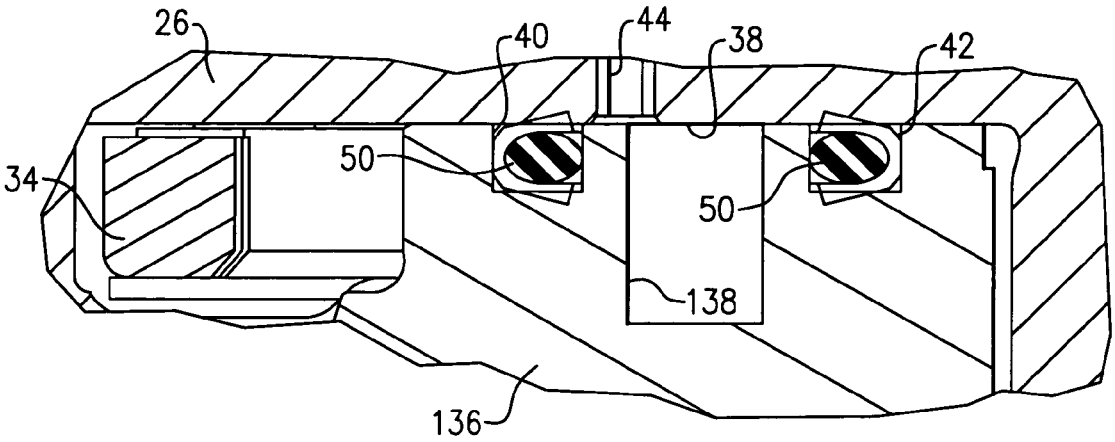
FIG. 2 shows a detail of an inventive scroll compressor.
Figure 3:
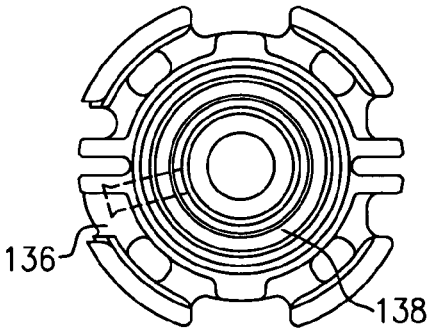
FIG. 3 shows a plan view of a crank case according to the present invention.

The present invention is shown in FIGS. 2 and 3, and provides a simple solution to the high start-up load problem mentioned above. As shown, a start-up cavity 138 is formed in the crank case 136. The cavity must be filled by refrigerant from the tap 44 at start-up before the orbiting scroll member 26 will be biased against the non-orbiting scroll member 24. Thus, there will be a relatively low load on the motor for a longer period of time after start-up. Once the cavity 138 is filled, then the orbiting scroll member 26 will be biased against the non-orbiting scroll member 24 and effective compression will begin.

FIG. 3 is a top view of the crank case 136 and shows that the groove 138 extends circumferentially about 360°.

As also shown in FIG. 2, the cavity 138 has a depth that is greater than the depth of the seal cavities 40 or 42. The cavity 138 also extends for a radial distance that is greater than the radial distance of the seal cavities 40 and 42. In disclosed embodiments, the cavity more than doubles the volume of the back pressure chamber. In one example, the volume is increased four-fold.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A scroll compressor comprising:

a first scroll member having a base and a generally spiral wrap extending from its base, and a second scroll member having a base and a generally spiral wrap extending from its base;

an electric motor for driving a shaft to cause said second scroll member to orbit relative to said first scroll member;

a back pressure chamber defined behind a base of one of said first and second scroll members, said back pressure chamber receiving a tapped refrigerant from a compression chambers, said back pressure chamber biasing said first and second scroll members together, and a start-up cavity formed in said back pressure chamber to increase a volume of said back pressure chamber and reduce a starting load on said electric motor, said back pressure chamber is defined by at least one seal receiving within a seal cavity, wherein said seal cavity extends for a first depth away from said base of said one of said first and second scroll members, and said start-up cavity extends from said base for a second depth, with said second depth being greater than said first depth; and said start-up cavity contains more than 50% of a volume of said back pressure chamber.

2. The scroll compressor as set forth in claim 1, wherein said back pressure chamber is defined behind said base of said second scroll member and a crank case that supports said second scroll member.

3. The scroll compressor as set forth in claim 1, wherein said start-up cavity extends as a continuous ring for 360° about an axis of rotation of said shaft.

4. The scroll compressor as set forth in claim 1, wherein there are two of seals and seal cavities, said seals being radially spaced, and said start-up cavity being radially intermediate said seal cavities.

5. The scroll compressor as set forth in claim 1, wherein said seal cavity extends for a first radial distance, and said start-up cavity extends for a second radial distance, said second radial distance being greater than said first radial distance.

6. A scroll compressor comprising:

a first scroll member having a base and a generally spiral wrap extending from its base, and a second scroll member having a base and a generally spiral wrap extending from its base;

an electric motor for driving a shaft to cause said second scroll member to orbit relative to said first scroll member;

a back pressure chamber defined behind a base of said second scroll member, said back pressure chamber receiving a tapped refrigerant from a compression chambers, said back pressure chamber biasing said first and second scroll members together, and a start-up cavity formed in said back pressure chamber to increase a volume of said back pressure chamber and reduce a starting load on said electric motor; and said start-up cavity extends as a continuous ring for 360° about an axis of rotation of said shaft, said back pressure chamber is defined by an at least one seal received within a seal cavity, wherein said seal cavity extends for a first depth away from said base of said one of said first and second scroll members, and said start-up cavity extends from said base for a second depth, with said second depth being greater than said first depth.

7. The scroll compressor as set forth in claim 6, wherein there are two of said seals and seal cavities, said seals being radially spaced, and said start-up cavity being radially intermediate said seal cavities.

8. The scroll compressor as set forth in claim 6, wherein said seal cavity extends for a first radial distance, and said start-up cavity extends for a second radial distance, said second radial distance being greater than said first radial distance.

9. The scroll compressor as set forth in claim 6, wherein said start-up cavity contains more than 50% of a volume of said back pressure chamber.

* * * * *

UNITED STATES PATENT AND TRADEMARK OFFICE

CERTIFICATE OF CORRECTION

PATENT NO. : 7,641,456 B2
APPLICATION NO. : 11/472105
DATED : January 5, 2010
INVENTOR(S) : Gregory W. Hahn It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 413 days.

Signed and Sealed this

Twenty-first Day of December, 2010

David J. Kappos

David J. Kappos
*Director of the United States Patent and Trademark Office*